US005834789A

United States Patent [19]

Marchione

[11] Patent Number: 5,834,789

[45] Date of Patent: Nov. 10, 1998

[54] RADIATION PROTECTIVE GARMENT

[76] Inventor: Robert L. Marchione, R.R.1, Box 60, Brookfield, Vt. 05036

[21] Appl. No.: 879,434

[22] Filed: Jun. 20, 1997

[51] Int. Cl.[6] ..... G21F 3/02

[52] U.S. Cl. ..... 250/516.1

[58] Field of Search ..... 250/516.1, 515.1, 250/519.1; 2/2.17, 48, 51, 338, 457

[56] References Cited

U.S. PATENT DOCUMENTS 4,417,146 11/1983 Herbert ..... 250/516.1

5,220,175 6/1993 Cole ..... 250/516.1

*Primary Examiner*—Kiet T. Nguyen

*Attorney, Agent, or Firm*—William Nitkin

[57] ABSTRACT

A radiation protective garment incorporating radiation resistant material is disclosed having two sturdy internal stay members which transfer all the weight of the garment off the wearer's shoulders to the waist/pelvic area of the wearer by a support belt securely positioned around the lower portions of the stay members located at the waist area of the wearer.

17 Claims, 9 Drawing Sheets

RADIATION PROTECTIVE GARMENT

BACKGROUND OF THE INVENTION

1. Field of the Invention

This invention resides in the area of radiation protective garments and more particularly relates to a radiation protective garment having two stay members which allow the top portion of the garment to be raised off the wearer's shoulders so that the weight of the garment, when the garment is cinched by a support belt at the waist of the wearer, is supported at the wearer's waist rather than on the wearer's shoulders.

2. Description of the Prior Art

During the past thirty years, while many new medical imaging technologies have been introduced and accepted, the usage of an older modality, x-ray fluoroscopy, has quietly proliferated. X-ray fluoroscopy has become an imaging tool not only of choice, but also of necessity. X-ray fluoroscopy provides the ability to see within the body in real time and has moved from usage for simple x-ray diagnosis to usage in a vast array of medical treatments.

With the evolution and proliferation of fluoroscopy, a broader group of medical professionals have become engaged in its daily use, and subject to its inherent danger, being exposure to radiation. Increasingly, nurses, surgeons, physicians and technologists, in addition to radiologists or radiologic technologists are either working with fluoroscopy or are present during its use.

While improving technology has decreased the radiation dose rates from what they were in the past, the use of fluoroscopy for treatment has not only expanded but has also called for increased exposure times, which length of radiation exposure often offsets the dose reductions realized by improved technology.

Thus, radiation safety is even more of an issue today than twenty-five years ago. Increasingly, personnel who are involved in the performance of these medical procedures are wearing radiation protective garments for longer periods of time. Radiation protective garments for use by persons subject to ionizing radiation during medical fluoroscopy or other activities are well known in the prior art. Such garments generally comprise inner cloth or vinyl linings and an outer cloth or vinyl covering with an intermediate layer of lead. This increased, prolonged usage of heavy radiation protective garments has caused the wearers of these garments certain types of fatigue and discomfort associated with the weight of the garment at the pressure points where the weight of the garment is transferred to the body.

A number of fatigue and discomfort problems have been directly linked to the weight of the garment that is placed upon the wearer's shoulders. Pressure upon the musculature of the shoulders and upper back has been identified as undesirable. Most recently physicians have identified this condition as "thoracic outlet syndrome" which has been directly linked to the weight of a radiation protective apron that bears upon the shoulders. In some cases even minimizing the weight on the shoulder area is insufficient to relieve the problem once it has manifested itself. Current treatment in severe cases of thoracic outlet syndrome can involve surgery.

SUMMARY OF THE INVENTION

It is an object of this invention to provide an ergonomic, improved radiation protective garment of the type used during medical x-ray fluoroscopic procedures in which the operator of the fluoroscopic equipment and other occupational personnel are subject to exposure by ionizing radiation, such as directly and indirectly from x-ray fluoroscopic equipment.

It is a further object of this invention to provide a radiation protective garment in which all of the garment's weight is supported at the waist and hips of the wearer.

The garment of this invention utilizes a pair of sturdy, inverted U-shaped stay members, the bottom portions of which, in one embodiment of the invention, are cinched by an elastic support belt. After cinching the belt over the bottom portions of the pair of stay members, the garment is manually raised and maintains this position by the support belt so that the upper portions of the garment are supported on the stay members and not on the shoulders of the wearer of the garment. In another embodiment of the invention the bottom portions of the stay members are disposed above the support belt. The belt supports and lifts the stay members, taking all of the garment's weight off the wearer's shoulders and transferring such weight to the waist/pelvic area of the wearer. As a result, all fatigue problems related to weight on the wearer's shoulders and prolonged shoulder contact are eliminated.

This removal of weight from the shoulders is achieved by using a semi-rigid plastic such as Lexan or metal stay members. In a preferred embodiment the stay members are stitched onto the inner lining or other wise disposed between the inner lining and other covering of the radiation protective garment. In all cases the stay members are maintained in their upward position by the action of an elastic support belt, causing a condition of zero weight load upon the shoulders of the wearer of the garment. One example of the garment of this invention utilizes two Lexan stay members each being 2½ inches wide by 36 inches long by ⅛ inch thick. Each stay member can be stitched into the inner lining of the garment and extends vertically from the back at the level of the support belt, at the waist area, up the back of the garment and arches over the shoulder of the wearer and proceeds downward to the level of the support belt, at the wearer's waist area, at the front of the garment, thus forming an inverted U-shaped member. The stay members can be removable from the garment in some embodiments. Different length stay members can be used for different sized garments. The stay members can be initially cut in a curved boomerang-like shape so that when the bottom ends are disposed opposite one another, the top curve of each stay member will be higher at the neck side of the shoulder to better fit the contour of its respective shoulder and be more comfortable to wear. Support belts are commonly used and well-known in the industry. The support belt holds the weight of the garment off the shoulders of the wearer by inward pressure against the garment, holding the uppermost parts of the stay members off the shoulders and preventing them from moving downward onto the shoulders. These stay members, in turn, lift the shoulder sections of the garment entirely off the user's shoulders. The support belt cannot move downward because it is attached to the garment and is held by its own compression tightly against the garment and wearer's body. The limited flexibility of the stay members provides the user with an adequate level of comfort to put on and take off the garment. A key feature of the invention is that the height of the garment as measured from a point on the support belt near the bottom of a stay member to the top of the garment at the shoulder area is greater than the distance from the same point on the support belt to the top of the wearer's shoulder crossed by the stay member, resulting in a space between the shoulder of the wearer and the garment.

DESCRIPTION OF THE PREFERRED EMBODIMENT(S)

Figure 1:
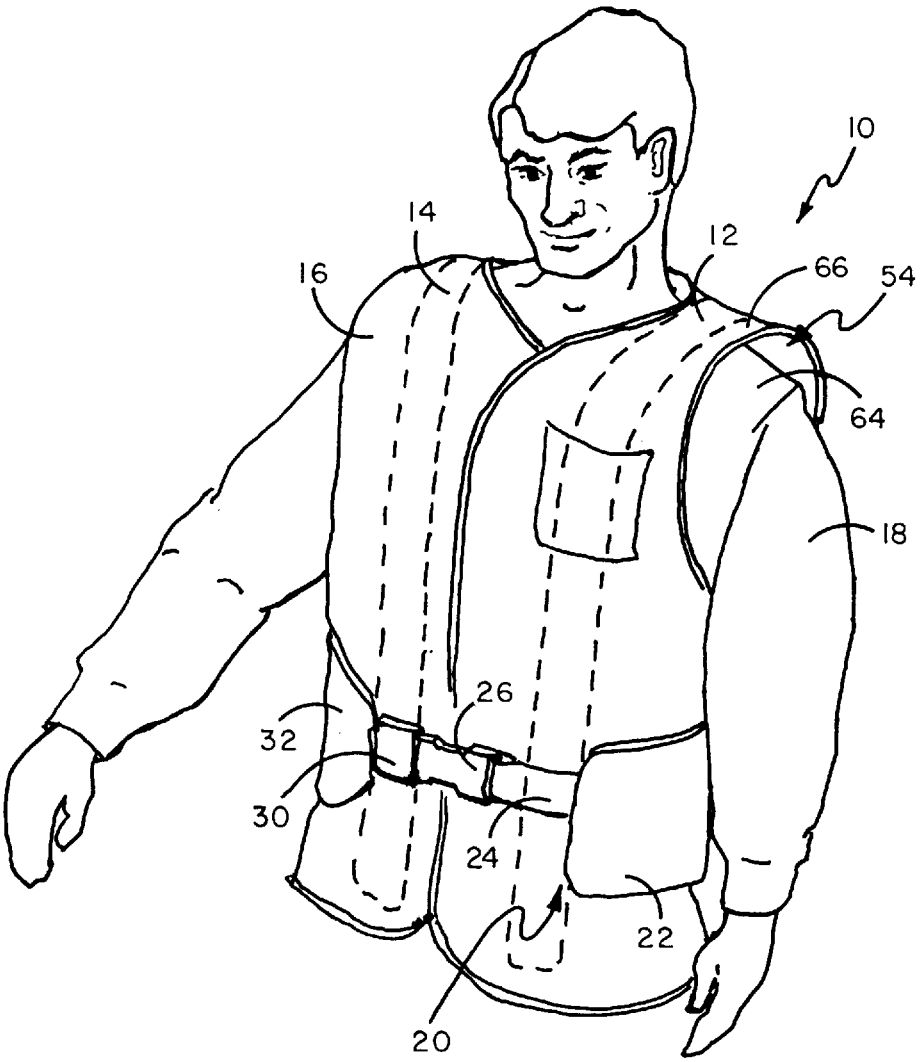
FIG. 1 illustrates a front perspective view of a person wearing one embodiment of the radiation protective garment of this invention.

In FIG. 1, radiation protective garment 10 of this invention is shown being worn by a person 18. The garment is snugly fastened around the person's body and held in a desired position by support belt 20 at the waist of the wearer. When the garment is worn, being properly adjusted and supported by support belt 20, there is a space 54 defined between the top of garment 10 and shoulder 64 of wearer 18 such that the top 66 of the garment does not make contact with the wearer's shoulders 64. Support belt 20 is positioned over garment 10 and is able to support the entire weight of garment 10 against the wearer's waist by being tightly cinched over the front and rear end portions of substantially vertical first and second stay members 14 and 12, which stay members are sufficiently sturdy to support the weight of the entire garment.

Figure 2:
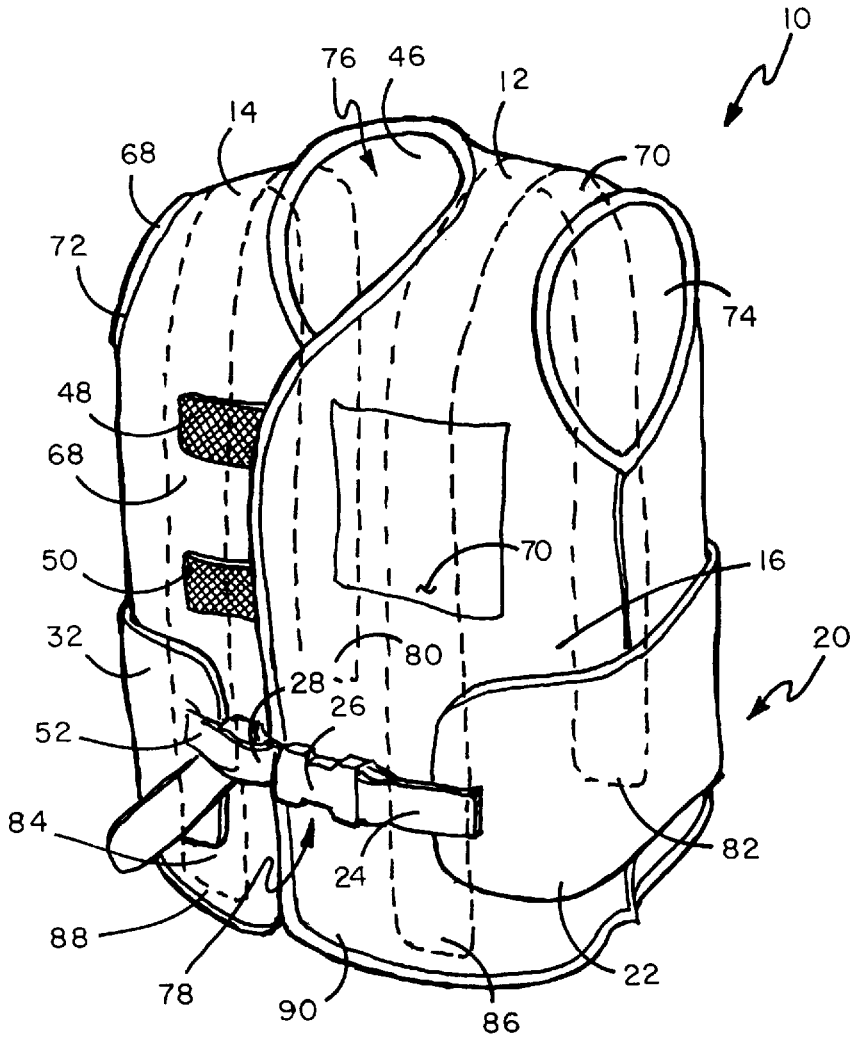
FIG. 2 illustrates a front perspective view of the garment of FIG. 1.

FIG. 2 illustrates a front view of radiation protective garment 10. This embodiment of the garment has first and second front panels 88 and 90 which close like a vest and are held together when closed by closure means such as Velcro strips 48 and 50 and their mating strips disposed inside second front panel 90 which are not seen in this view. The upper portion of garment 10 has first and second shoulder area portions 68 and 70 covering the wearer's shoulders, first and second arm holes 72 and 74, and neck opening 76. The lower portion of garment 10 has belt receipt area 78 where support belt 20 can be wrapped therearound and tightened around the wearer's waist. The belt can be adjusted and then fastened together by mating buckles 26 and 28. The garment includes outer covering 16 and inner lining 46 which can be stitched together at the edges of the garment. Particles of lead or other radiation-attenuating materials are encapsulated in a flexible vinyl matrix and sandwiched between outer covering 16 and inner lining 46, protecting the wearer of garment 10 against radiation exposure. First and second stay members 14 and 12 can be stitched to inner lining 46 of garment 10, or alternatively they can be sewn to outer covering 16. First and second stay members 14 and 12 proceed vertically, respectively, from their rear ends 80 and 82 disposed inward of support belt 20 at the rear of garment 10, and extend up and arch over the wearer's shoulders and proceed downward to their respective front ends 84 and 86 disposed inward of support belt 20 at the wearer's waist area at the front of the garment. A plurality of sets of Velcro strips 48, 50, and 52 are fixed to the outer surface of first front panel 88 of garment 10 and extend horizontally therefrom. Mating complementary Velcro strips are attached to the inside surface of second front panel 90 of garment 10, not shown herein. These mating sets of Velcro strips on the front panels are located so as to substantially overlie each other when the front panels are closed around the body of the wearer. In this way, the overlapping front panels will be held together to prevent garment 10 from opening. Since the Velcro strips extend horizontally, they can mate at different positions, thus allowing a single garment of this invention to be comfortably worn by persons of different girth. The radiation protective garment of this invention can be provided in different sizes to accommodate all wearers of the garment.

Figure 3:
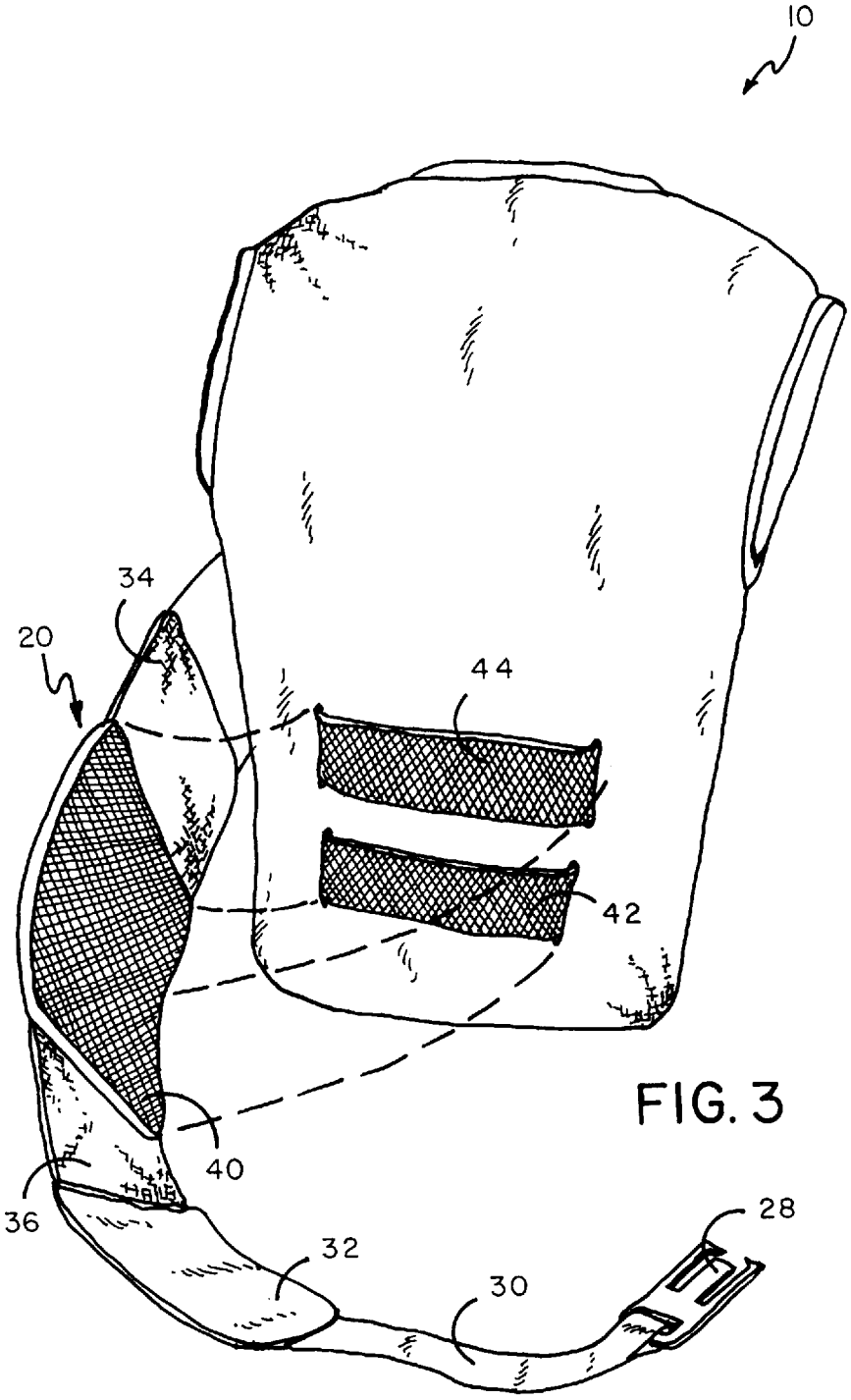
FIG. 3 illustrates a rear perspective view of the garment of FIG. 1 with belt unbuckled and partially separated from the garment.

FIG. 3 shows a rear view of garment 10 with support belt 20 partially separated therefrom. Two attachment means, such as two Velcro or equivalent strips 42 and 44 are fixed to the lower rear portion of the waist area of garment 10. Complementary Velcro strip 40 or equivalent attachment mating means can be affixed to the central inside portion of support belt 20 such that strip 40 substantially overlies strips 42 and 44 when support belt 20 is attached to garment 10, thereby interconnecting Velcro strips 44 and 42 to Velcro strip 40 and providing a secure attachment of support belt 20 to garment 10.

Figure 4:
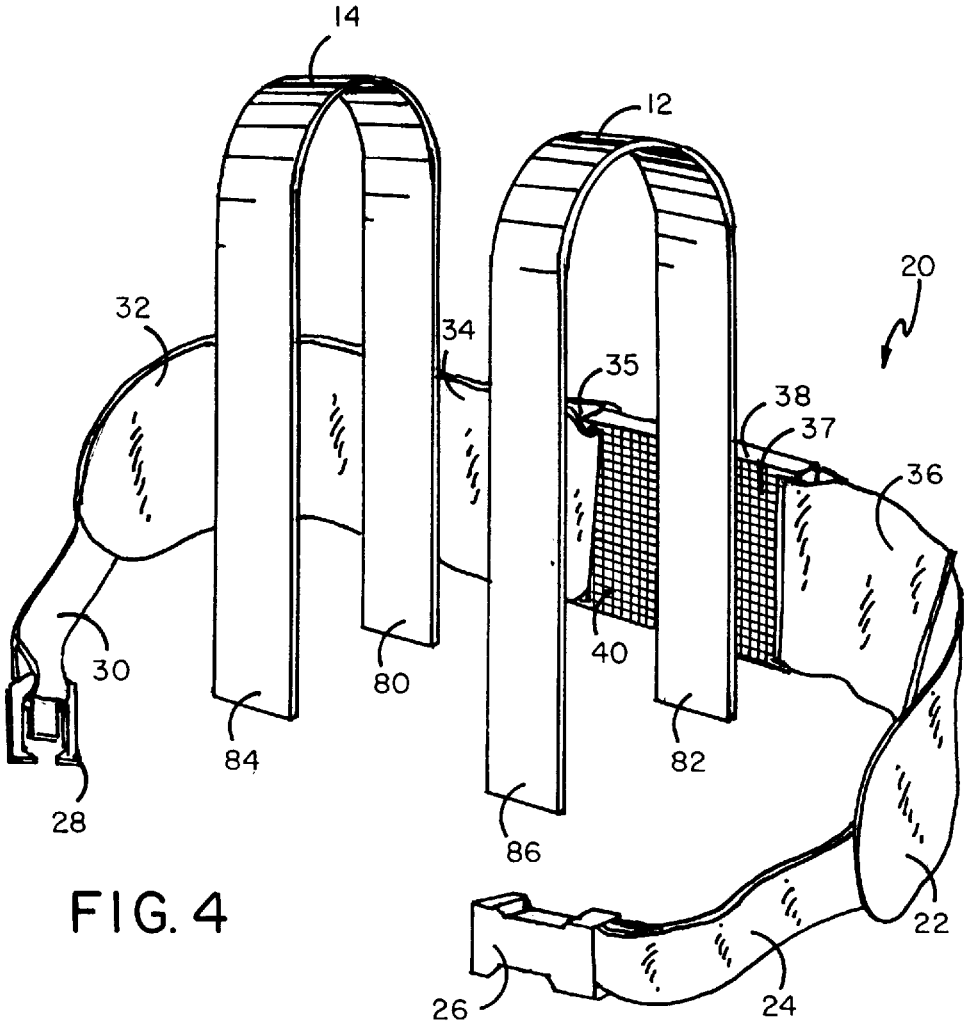
FIG. 4 illustrates a perspective view of the two vertical stay members and support belt of the garment of FIG. 1 shown separate from the garment.

FIG. 4 illustrates a perspective view of support belt 20 and substantially vertical first and second stay members 14 and 12 with the remainder of the garment not shown. Support belt 20 is of the type commonly used in the industry but in addition has the attachment mating means being strip 40 thereon. As discussed above, the support belt can be attached by Velcro strips to the rear of garment 10 and surrounds the garment when buckle means 26 and 28 are attached to one another. The support belt has a central portion 38 to which Velcro strip 40 is fixed on the inside. Attached respectively at first and second ends 35 and 37 of central portion 38 are first and second elasticized elements 34 and 36. First and second elasticized elements 34 and 36, in turn, are attached respectively to connecting elements 32 and 22, which, in turn, are attached to adjustable fastening means consisting of straps 30 and 24 and mating buckle means 28 and 26. At least one of the mating buckles includes conventional means for adjusting the length of the strap(s). First and second stay members 14 and 12 can be made from either a rigid or semi-rigid plastic or metal strips of sufficient strength to support the weight of garment 10, which can typically be 10 lbs of weight, off the wearer's shoulders. In one preferred embodiment, first and second stay members 14 and 12 can each be made from Lexan plastic in the following dimensions: 2½ inches wide by 36 inches long by ⅛ inch thick. As seen in FIG. 2, the stay members can be sewn into inner lining 46 of garment 10 or attached by well-known means of attachment; and the front and rear end portions 80, 82, 84 and 86 of the stay members extend down to the waist/pelvic area of the wearer so as to be within the area surrounded by support belt 20. Support belt 20 can apply pressure on the stay members when the belt is tightened against the garment and the wearer's body therewithin so as to maintain the bottom portions of the stay members in position when they are manually positioned not to have their shoulder portions resting on the wearer's shoulders.

Figure 5:
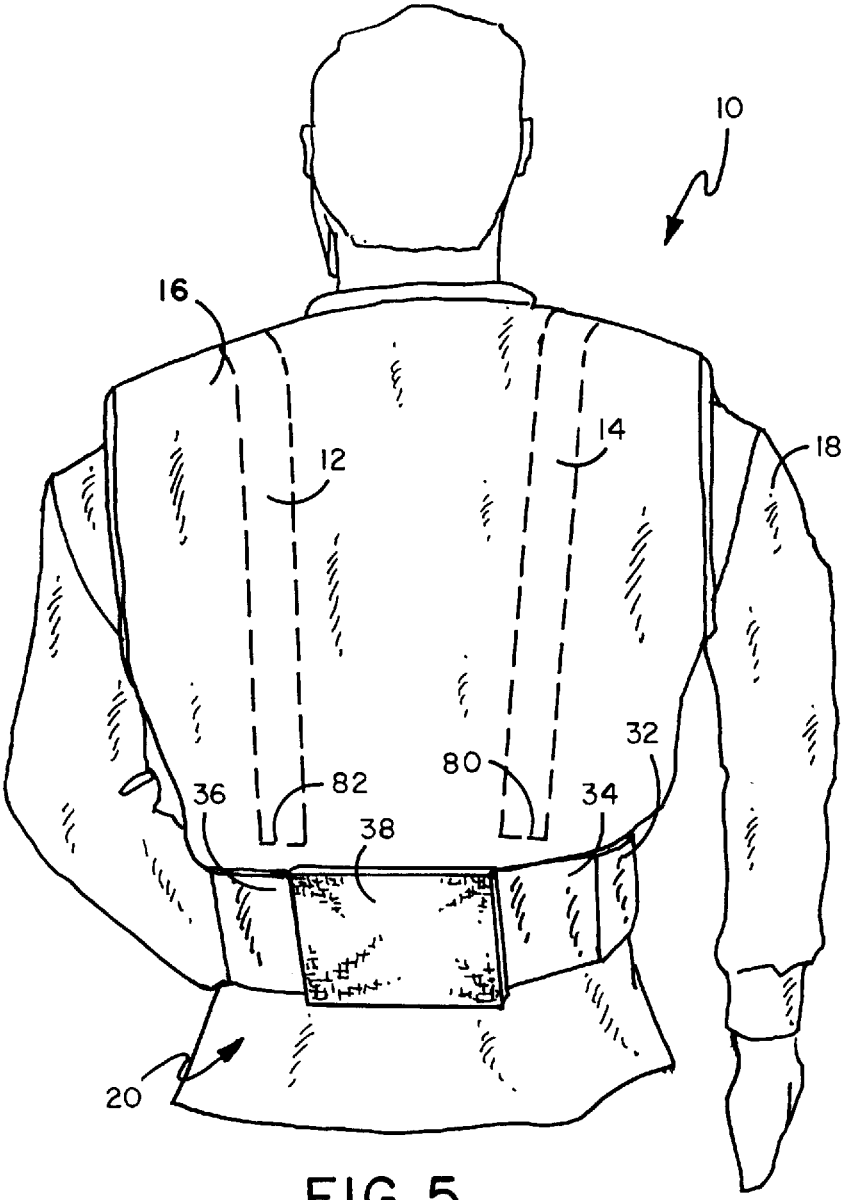
FIG. 5 illustrates a rear perspective view of a person wearing the garment of FIG. 1.

FIG. 5 illustrates a rear view of support belt 20 fastened around a person wearing garment 10. In this embodiment of the garment of this invention the stay members' rear ends 80 and 82 are supported above the support belt by the inward pressure of the support belt in conjunction with the stiffness of the garment's material.

Figure 6:
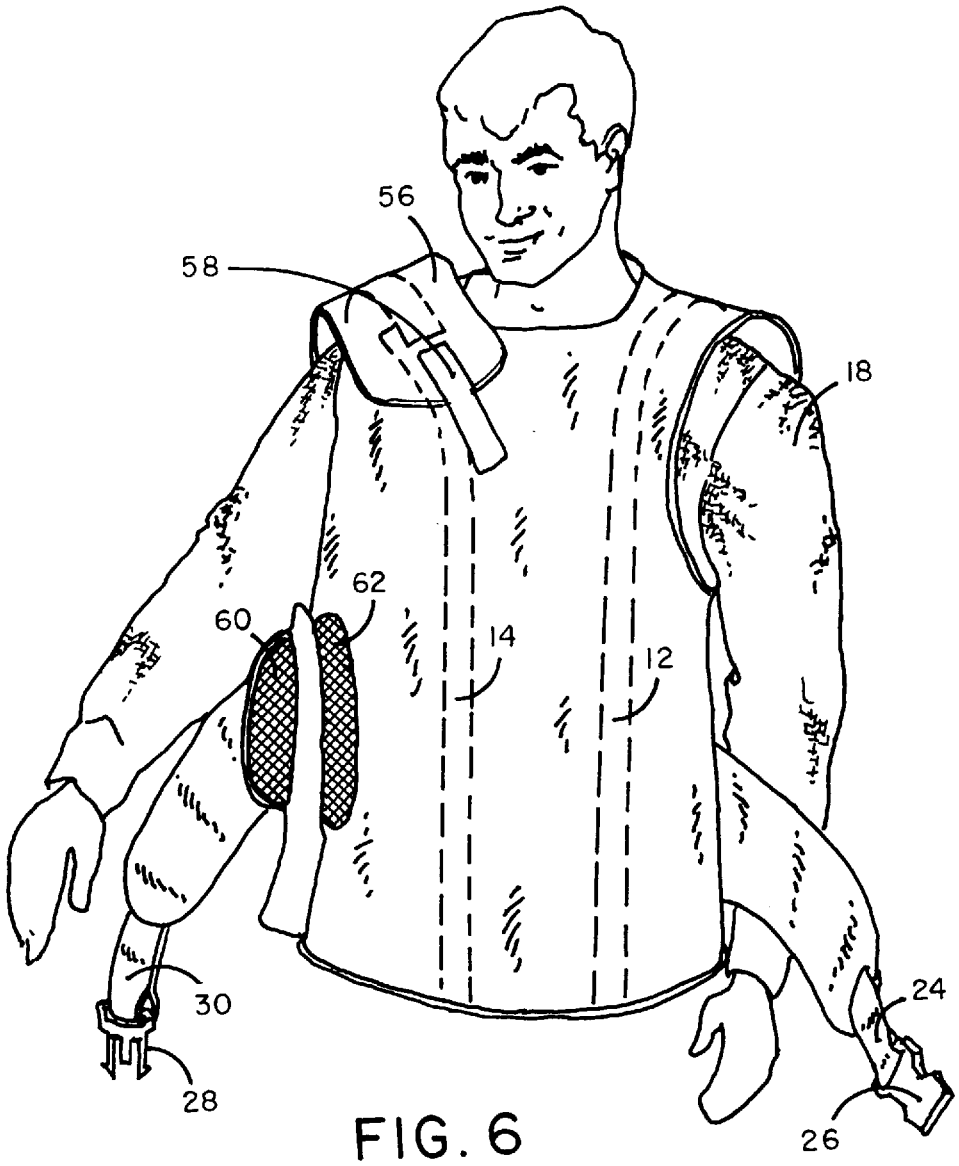
FIG. 6 illustrates a front perspective view of a person wearing an alternate embodiment of the garment of this invention having openings at the side and across one shoulder.

FIG. 6 illustrates an alternate embodiment of the garment of this invention. In this embodiment garment 10 opens along one side and across one shoulder of the garment. The side and shoulder closure members are held together by Velcro strips. The shoulder opening is fastened over the shoulder when rear shoulder flap 56 is connected to the front of the garment by Velcro strip 58. Mating Velcro pieces can be placed on the garment as seen in the first embodiment discussed above to secure support belt 20 in position. The garment is also fastened at one side of the wearer by overlapping side Velcro closures 60 and 62. Velcro closure 60 is fixed on the inner lining of the rear of the garment, while Velcro closure 62 is situated on the exterior of the outer covering of the garment. In the embodiment of FIG. 6 first and second stay members 14 and 12 are positioned substantially vertically within the garment, but first stay member 14 is split into two portions at shoulder flap 56. When shoulder flap 56 is closed, a strong enough connection is provided for first stay member 14 to act in the same manner as a continuous, non-split stay member to support the weight of the garment in conjunction with second stay member 12 off the wearer's shoulders.

Figure 7:
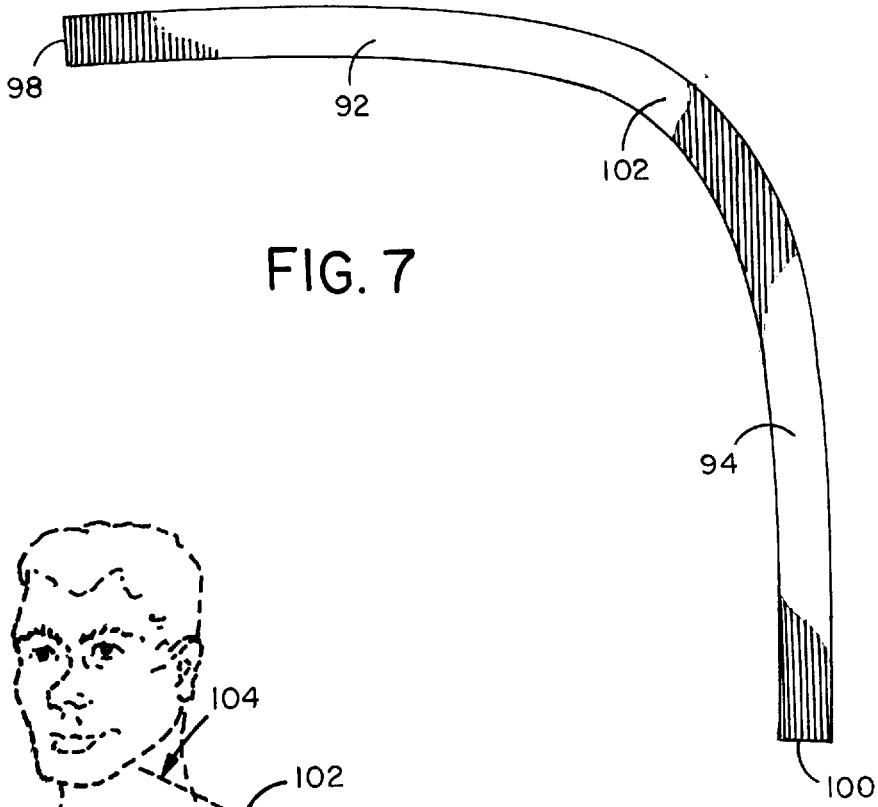
FIG. 7 illustrates a top view of a stay member cut in a curved shape.
Figure 8:
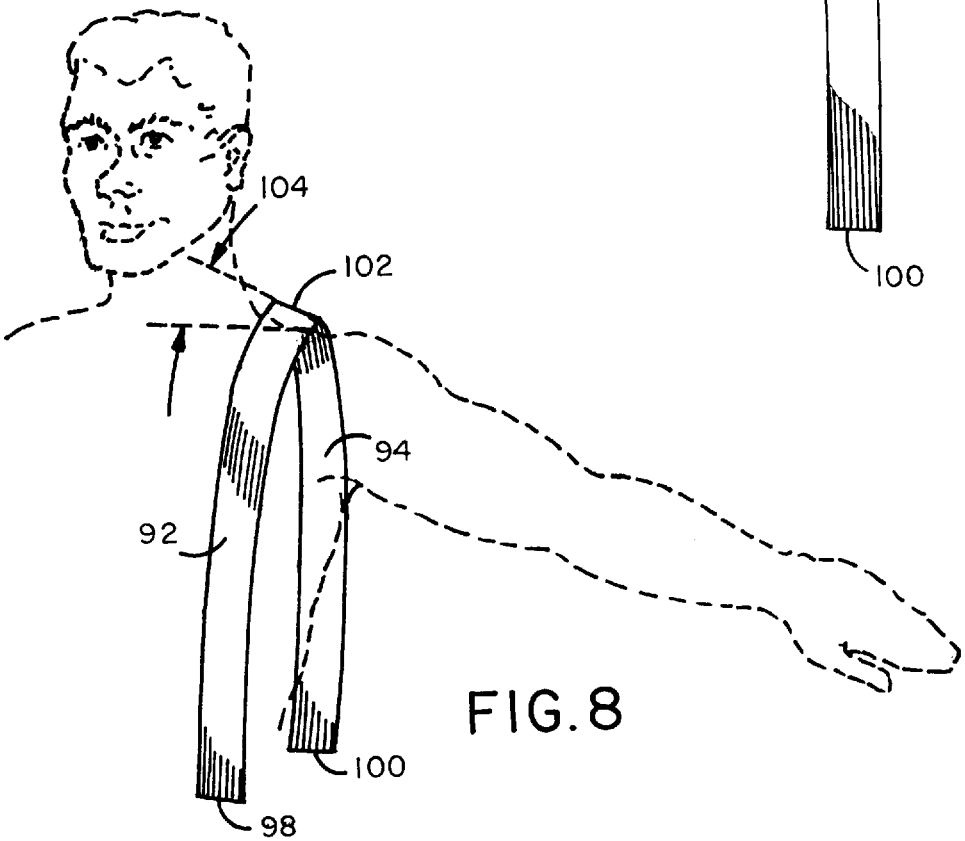
FIG. 8 illustrates a perspective front view of the curved stay member of FIG. 8 in position on a wearer.

FIG. 7 illustrates a top view of a planar stay member cut in a curved shape somewhat like a boomerang. FIG. 8 shows the curved stay member of FIG. 7 in position on a wearer with the remaining parts of the garment not shown with the stay member's first and second ends 98 and 100 aligned with one another at the waist area of the wearer. First portion 92 of the stay member extends upward on the front and second portion 94 extends upward on the rear to top area 102, where, because of the curve of the stay member, the top portion is bent at an angle 104 so as to align itself with the natural curve of the shoulder of the wearer. The stay member used on the opposite side of the garment, not shown herein, is bent in the reverse direction with first portion 92 extending upward on the rear of the garment, and second portion 94 extending upward on the front of the garment so that its slope at its top will conform generally to the slope of the shoulder of the wearer. The use of stay members, each angularly disposed at its top area 104 within a radiation protective garment helps the garment fit more comfortably even though the garment does not contact the shoulders of the wearer when the garment is properly adjusted for use.

Figure 9:
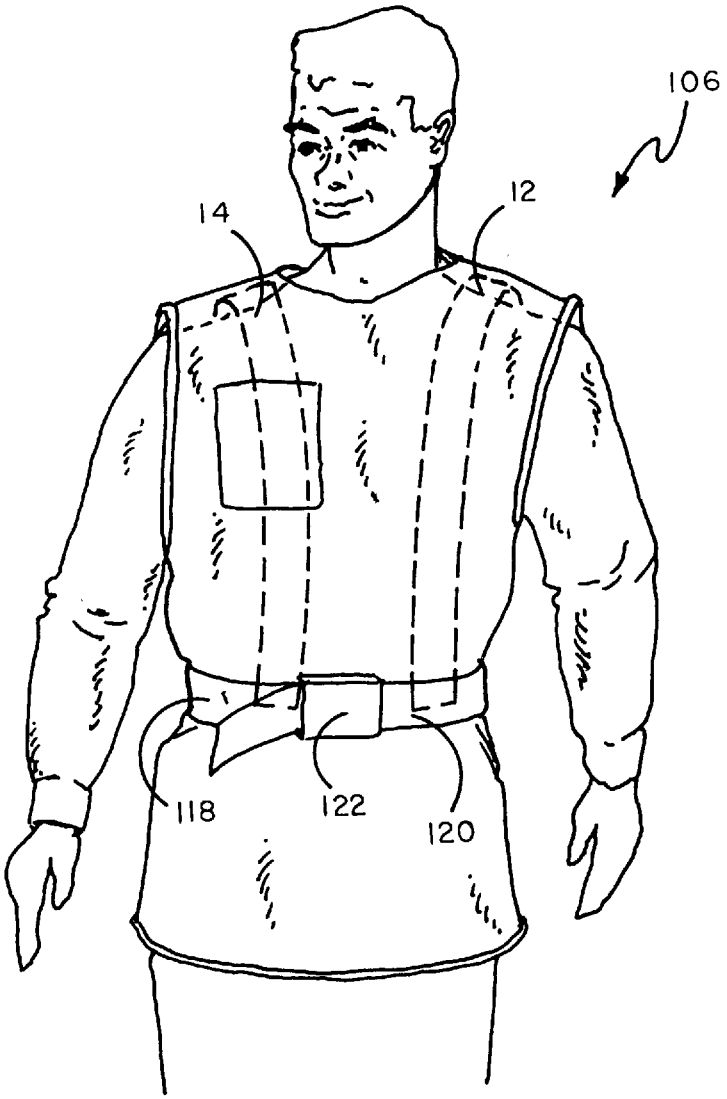
FIG. 9 illustrates a front perspective view of a further alternate embodiment of the garment of this invention having a rear opening.
Figure 10:
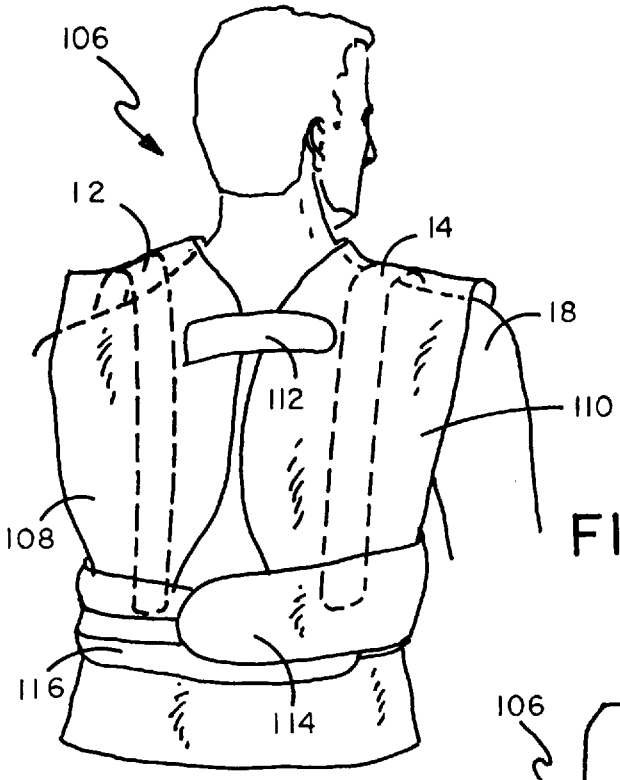
FIG. 10 illustrates a rear view of the embodiment of FIG. 9 with rear straps closed position.
Figure 11:
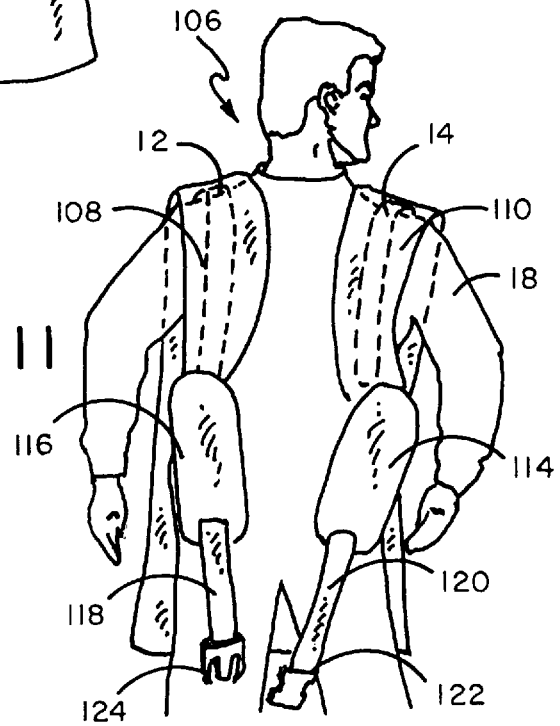
FIG. 11 illustrates a rear view of the embodiment of FIG. 9 with rear straps open.

FIG. 9 illustrates a further alternate embodiment of the garment of this invention which opens at the rear of the garment. Seen in this view is garment 106 with first and second stay members 14 and 12 shown in outline form. FIGS. 10 and 11 illustrate a rear view of garment 106 where first and second rear side panels 110 and 108 come together at the center of the back of the wearer. Velcro attachment strap 112 can hold the upper portions of first and second rear side panels 110 and 108 together. First and second stretchable members 114 and 116 can be attached at the waist area of the garment with first and second straps 120 and 118 attached, respectively, thereto and with first and second buckles 122 and 124 extending, respectively, from first and second straps 120 and 118. First and second stretchable members 114 and 116, which can contain cushioning, are crossed over one another behind the wearer's back and tightly cinched over the bottoms of the rear of first and second stay members 14 and 12 with first and second straps 120 and 118 extending around to the front of the garment where they are buckled together snugly, thereby retaining and supporting the front bottom portions of first and second stay members 14 and 12.

Although the present invention has been described with reference to particular embodiments, it will be apparent to those skilled in the art that variations and modifications can be substituted therefor without departing from the principles and spirit of the invention.

I claim:

1. A radiation protective garment for use by a wearer having a waist and shoulders, comprising:

a flexible inner lining and outer covering containing radiation protective material disposed therebetween, said garment having a weight, a first side, a second side, a front portion having a top portion, a waist portion and a bottom portion, a rear portion having a top portion, and two shoulder portions;

first and second stay members each formed in an inverted U-shape, said first and second stay members disposed within said garment, each stay member having front and rear ends and a top portion, each stay member extending from its front end at its respective front waist portion of said garment vertically over its respective top portion corresponding to a shoulder area of the wearer and downward to its rear end at a rear waist portion of said garment; and a support belt having means to attach said belt to said outer covering at said rear waist portion of said garment and means for securing said support belt tightly around said front waist portion of said garment;

said support belt for manually positioning said top portions of said first and second stay members above said shoulders of said wearer wherein all of said weight of said garment is supported by said first and second stay members which are held in place by the pressure of said support belt on said front and rear ends of said stay members against said waist of said wearer.

2. The garment of claim 1 wherein said first and second stay members are disposed between said inner lining and said outer covering of said garment.

3. The garment of claim 2 wherein said first and second stay members are made from a semi-rigid plastic sufficiently strong to support and remove the weight of said garment from said wearer's shoulders.

4. The garment of claim 3 wherein said first and second stay members are made from a metal sufficiently strong to support and remove the weight of said garment from said wearer's shoulders.

5. The garment of claim 4 wherein said means for securing said support belt include an elasticized stretchable member.

6. The garment of claim 5 wherein said means secured said support belt to said garment are Velcro fastening means.

7. The garment of claim 6 further including a front opening defined in said front portion of said garment, said garment having first and second front panels openable on said front portion of said garment, said first and second front panels including Velcro fastening means for securing said first front panel to said second front panel to close said opening in said front portion of said garment.

8. The garment of claim 7 wherein said garment opens on one side and at the shoulder portion corresponding to that side of the garment, said stay member located on said opening side being separated at said shoulder opening, forming a first stay member first portion and a first stay member second portion.

9. The garment of claim 6 wherein said garment opens at said rear portion, said rear portion formed of a first rear side panel and a second rear side panel, said first and second rear side panels having first and second belt members attached, respectively, thereto which cross over one another in opposite directions to surround the waist of the wearer to be joined and tightened at said front portion of said garment.

10. The garment of claim 6 wherein said first and second stay members are planar members cut in a curved shape.

11. The garment of claim 3 wherein said means for securing said support belt include an elasticized stretchable member.

12. The garment of claim 11 wherein said means secured said support belt to said garment are Velcro fastening means.

13. The garment of claim 12 further including a front opening defined in said front portion of said garment, said garment having first and second front panels openable on said front portion of said garment, said first and second front panels including Velcro fastening means for securing said first front panel to said second front panel to close said opening in said front portion of said garment.

14. The garment of claim 12 wherein said garment opens on one side and at the shoulder portion corresponding to that side of the garment, said stay member located on said opening side being separated at said shoulder opening, forming a first stay member first portion and a first stay member second portion.

15. The garment of claim 12 wherein said garment opens at said rear portion, said rear portion formed of a first rear side panel and a second rear side panel, said first and second rear side panels having first and second belt members attached, respectively, thereto which cross over one another in opposite directions to surround the waist of the wearer to be joined and tightened at said front portion of said garment.

16. The garment of claim 12 wherein said first and second stay members are planar members cut in a curved shape.

17. A method of supporting the weight of a radiation protective garment on the waist/pelvic area of a wearer, said garment for use in an environment of x-ray radiation, said garment having a front, a back, first and second side portions, a waist area portion, and first and second shoulder portions, said first and second shoulder portions each having a top point, comprising the steps of:

providing first and second stay members disposed, respectively, within said garment on said first and second side portions thereof, each of said stay members extending from its respective front waist area portion of said garment, over its respective shoulder portion, and down to its respective back waist area portion of said garment;

providing a support belt attached at said waist area portion of said garment;

securing said support belt tightly about said waist area portion of said garment; and manually lifting said garment such that the distance from a point on said support belt near the bottom of a stay member at said waist of the wearer to the top of his shoulder is less than the distance measured from said point on said support belt to the top point of its respective shoulder portion of said garment;

maintaining said first and second stay members at said distance where its shoulder portions are positioned above and off the shoulders of said wearer; and supporting said weight of said garment on said first and second stay members by pressure of said support belt securely positioned against said waist portion of said garment.

* * * * *